US010759631B2

(12) United States Patent
Shi et al.

(10) Patent No.: US 10,759,631 B2
(45) Date of Patent: Sep. 1, 2020

(54) REMOTE TRIGGERING DEVICE, OVERSPEED GOVERNOR ASSEMBLY AND ELEVATOR

(71) Applicant: Otis Elevator Company, Farmington, CT (US)

(72) Inventors: Zhengbao Shi, Shanghai (CN); Randall S. Dube, Glastonbury, CT (US); Yong Zhao, Shanghai (CN); Min Wang, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 265 days.

(21) Appl. No.: 15/794,306

(22) Filed: Oct. 26, 2017

(65) Prior Publication Data

US 2018/0118515 A1 May 3, 2018

(30) Foreign Application Priority Data

Oct. 27, 2016 (CN) ..... 2016 1 0953388

(51) Int. Cl.
*B66B 5/04* (2006.01)

(52) U.S. Cl.
CPC ..... *B66B 5/044* (2013.01); *B66B 5/04* (2013.01); *B66B 5/048* (2013.01)

(58) Field of Classification Search
CPC ..... B66B 5/044; B66B 5/048
See application file for complete search history.

(56) References Cited

U.S. PATENT DOCUMENTS 5,565,660 A * 10/1996 Karner ..... B66B 5/044 187/276
5,630,483 A * 5/1997 Karner ..... B66B 5/048 187/350

(Continued)

FOREIGN PATENT DOCUMENTS

CN 85109248 A 7/1986
CN 1319550 A 10/2001

(Continued)

OTHER PUBLICATIONS

European Search Report for application EP 1719888, dated May 4, 2018, 9 pages.

(Continued)

*Primary Examiner* — Minh Truong
(74) *Attorney, Agent, or Firm* — Cantor Colburn LLP

(57) ABSTRACT

The present invention provides a remote trigger device, a speed limiter assembly having the same and an elevator. The remote trigger device for the speed limiter assembly comprises: an actuator; and a rotating component, the rotating component being capable of rotating around a rotating axis in a rotating plane, the rotating component being actuated by the actuator to rotate from an idle position to a working position. During rotation of the speed limiter assembly, at the idle position, the rotating component is kept separated from an over-speed locking mechanism of the speed limiter assembly, and at the working position, the rotating component toggles a trigger member of the over-speed locking mechanism of the speed limiter assembly to trigger the speed limiter assembly. The structure of the remote trigger device according to the present invention is compact and simple.

17 Claims, 8 Drawing Sheets

(56) References Cited

U.S. PATENT DOCUMENTS

| | | | | |
|---|---|---|---|---|
| 7,537,090 | B2 * | 5/2009 | Vantanen | B66B 5/04 187/286 |
| 8,136,795 | B2 | 3/2012 | Dube | |
| 8,453,799 | B2 | 6/2013 | Mueller et al. | |
| 8,931,598 | B2 | 1/2015 | Aguado et al. | |
| 9,359,173 | B2 | 6/2016 | Dube | |
| 2011/0272223 | A1 * | 11/2011 | Drayer | B66B 5/044 188/65.1 |
| 2015/0136544 | A1 | 5/2015 | Dube et al. | |
| 2015/0329322 | A1 * | 11/2015 | Osmanbasic | B66B 5/046 187/373 |
| 2018/0029828 | A1 * | 2/2018 | Shi | B66B 5/044 |

FOREIGN PATENT DOCUMENTS

| | | | |
|---|---|---|---|
| CN | 2517715 | Y | 10/2002 |
| CN | 2542632 | Y | 4/2003 |
| CN | 100335395 | C | 9/2007 |
| CN | 100360390 | C | 1/2008 |
| CN | 100537389 | C | 9/2009 |
| CN | 101233067 | B | 5/2010 |
| CN | 1960930 | B | 12/2010 |
| CN | 102196986 | A | 9/2011 |
| CN | 101061053 | B | 4/2012 |
| CN | 101821187 | B | 1/2013 |
| CN | 102216189 | B | 8/2013 |
| CN | 103261072 | A | 8/2013 |
| CN | 101992983 | B | 10/2013 |
| CN | 103407855 | A | 11/2013 |
| CN | 203450987 | U | 2/2014 |
| CN | 103803371 | B | 8/2016 |
| EP | 2380840 | A1 | 10/2011 |
| EP | 2243739 | B1 | 11/2012 |
| GB | 191417548 | A | 8/1915 |
| KR | 200200007 | Y1 | 10/2000 |
| WO | 2007149079 | A1 | 12/2007 |
| WO | 2009130366 | A1 | 10/2009 |
| WO | 2016087530 | A1 | 6/2016 |

OTHER PUBLICATIONS

Chinese First Office Action for application CN 201610953388.6, dated Jan. 21, 2020.

* cited by examiner

REMOTE TRIGGERING DEVICE, OVERSPEED GOVERNOR ASSEMBLY AND ELEVATOR

FOREIGN PRIORITY

This application claims priority to Chinese Patent Application No. 201610953388.6, filed Oct. 27, 2016, and all the benefits accruing therefrom under 35 U.S.C. § 119, the contents of which in its entirety are herein incorporated by reference.

TECHNICAL FIELD

The present invention relates to the technical field of speed limiters of elevators, and in particular, to a remote trigger device for a speed limiter assembly, a speed limiter assembly having a remote trigger device and an elevator.

BACKGROUND ART

A speed limiter assembly is configured in an elevator system to prevent the speed of an elevator car from exceeding a predetermined value. Generally, the speed limiter assembly is associated with a rope sheave and a rotating speed of the rope sheave corresponds to the speed of the elevator car. When the rotating speed of the rope sheave exceeds a certain value, a mechanism based on a centrifugal force triggers an over-speed locking mechanism which rotates with the rope sheave, so as to trigger the speed limiter assembly and start a safety device such as a safety gear and the like to brake the car in a guide rail friction mode. This speed limiter assembly further comprises a remote trigger device. The remote trigger device can be actively controlled to act on the over-speed locking mechanism, such that the speed limiter assembly can be triggered when the car has not been over-speed yet for testing purposes, for example.

SUMMARY OF THE INVENTION

An object of the present invention is to solve or at least relieve problems existing in the prior art.

In order to realize the above-mentioned technical object, according to one aspect of the present invention, the present invention provides a remote trigger device for a speed limiter assembly, comprising:

an actuator; and a rotating component, the rotating component being capable of rotating around a rotating axis in a rotating plane, the rotating component being actuated by the actuator to rotate from an idle position to a working position, wherein at the idle position, the rotating component is kept separated from an over-speed locking mechanism of the speed limiter assembly, and at the working position, the rotating component toggles a trigger member of the over-speed locking mechanism of the speed limiter assembly to trigger the speed limiter assembly.

According to other aspects of the present invention, the present invention further provides a speed limiter assembly having the remote trigger device according to the embodiment of the present invention and an elevator.

BRIEF DESCRIPTION OF THE DRAWINGS

By referring to the drawings, the content disclosed by the present invention will be easier to understand. One skilled in the art can easily understand that these drawings are merely used for the purpose of description and are not used for limiting the protection scope of the present invention. Besides, similar numbers in the drawings are used for representing similar components, wherein.

DETAILED DESCRIPTION

Figure 1:
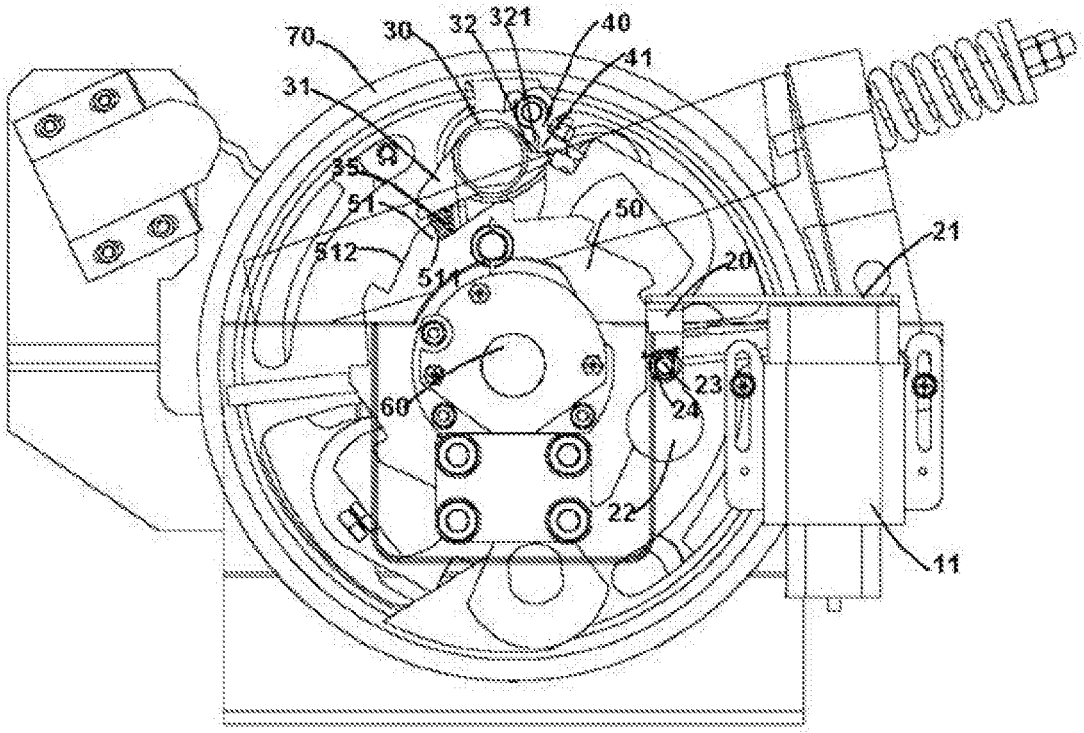
FIG. 1 illustrates a front view of a speed limiter assembly according to a first embodiment of the present invention.

It is easy to understand that one skilled in the art may provide various structural forms and implementation modes which are mutually replaceable according to the technical solution of the present invention without changing the essential spirit of the present invention. Therefore, the following specific embodiments and drawings are merely used for exemplarily describing the technical solution of the present invention, and shall not be considered as all of the present invention or considered as a restriction or limitation to the technical solution of the present invention.

Orientation terms such as "above", "below", "left", "right", "front", "rear", "front surface", "back surface", "top" and "bottom" and the like which are mentioned or possibly mentioned in the description are defined with respect to the configurations illustrated in the drawings, they are relative concepts and thus they may be correspondingly changed according to different positions and different use states. Therefore, these or other orientation terms shall not be explained as restrictive terms.

A first embodiment of the present invention will be described with reference to FIG. 1 to FIG. 8. Firstly, reference is made to FIG. 1 and FIG. 2, which illustrate a speed limiter assembly according to the first embodiment of the present invention. The speed limiter assembly comprises a rope sheave 70, an outer side surface of the rope sheave 70 is provided with a rope groove such that a rope can be wound around the rope sheave 70. Due to this structure, the rope sheave 70 may rotate along the rope such that the rope sheave 70 rotates at an angular speed corresponding to a running speed of a car and in a direction corresponding to a running direction of the car. In all embodiments, it is assumed that an anticlockwise rotating direction of the rope sheave corresponds to a descending direction of an elevator car and a clockwise rotating direction of the rope sheave corresponds to an ascending direction of the elevator car. The speed limiter assembly further comprises an over-speed locking mechanism. For example, the over-speed locking mechanism comprises a shaft 60, a ratchet wheel 50 fixedly connected with the shaft 60, a ratchet tooth 30 and a tripping bar 40. As illustrated in FIG. 1, the speed limiter assembly is not triggered and the rope sheave 70 can freely rotate. The ratchet tooth 30 and the tripping bar 40 are both rotatably mounted onto the rope sheave 70 so as to rotate with the rope sheave 70. The ratchet tooth 30 has a tendency to anticlockwise rotate due to traction of a spring 35 at a first end 31 thereof. A tooth groove 321 at a second end 32 of the ratchet tooth 30 is exactly fitted with a tooth 41 of the tripping bar 40, such that the ratchet tooth 30 and the tripping bar 40 can be kept at a non-trigger position illustrated in FIG. 1. The tripping bar 40 is rotatably mounted onto the rope sheave 70 through a pin 44 and a torsion spring 43, wherein the torsion spring enables the tripping bar 40 to be biased to have a tendency to rotate in the clockwise rotating direction, so as to keep a fitting position between the tooth 41 and the tooth groove 321. At the non-trigger position, the rope sheave 70 can freely rotate in the clockwise direction corresponding to ascending of the elevator car and the anticlockwise direction corresponding to descending of the elevator car. With the acceleration of the running of the elevator car, a centrifugal force acting on a centrifugal block arranged on a back side of the rope sheave 70 is caused to increase, such that the centrifugal block overcomes a retaining force provided by an elastic device to gradually outwards move in a radial direction, till it toggles a portion of the tripping rod 40 which penetrates through the rope sheave 70. The tooth 41 of the tripping bar thereby slides out of the tooth groove 321 at the second end 32 of the ratchet tooth 30. Thereafter, the ratchet tooth 30 anticlockwise rotates relative to the rope sheave 70 under the effect of the spring 35 and is engaged with a tooth 51 of the corresponding ratchet wheel 50. The tooth 51 of the ratchet wheel 50 abuts against the first end 31 of the ratchet tooth 30. Due to the special configuration of the tooth 51 of the ratchet wheel 50 and the fixed connection between the ratchet wheel 50 and the shaft 60, when the speed limiter assembly anticlockwise rotates and the first end 31 of the ratchet tooth 30 abuts against a first side 511 of the tooth 51 of the ratchet wheel, rotation of the rope sheave 70 in the anticlockwise direction is restricted. The speed limiter assembly is thereby triggered and related safety devices are driven to brake the elevator car.

Under some circumstances, for example, for the purpose of testing, it is expected to actively trigger the speed limiter assembly under a situation in which the elevator car has not been over-speed. Therefore, under a general circumstance, the speed limiter assembly is further provided with a remote trigger device. The remote trigger device may actively trigger the speed limiter assembly in response to, for example, a control switch located in an elevator control room. The limiter speed assembly according to the present invention is provided with a remote trigger device. The remote trigger device substantially comprises an actuator 11 and a rotating component 20. The actuator 11 may be any device capable of executing movement in response to remote control, such as an electromagnet capable of executing linear movement. With respect to the rotating component 20, it can rotate around a rotating axis A-A in a plane, and the plane in which the rotating component rotates is called as a rotating plane. The rotating component is actuated by the actuator 11 to rotate from an idle position illustrated in FIG. 1 to a working position illustrated in FIG. 6 to FIG. 8. At the idle position, the rotating component 20 is kept separated from the over-speed locking mechanism of the speed limiter assembly, and at the working position, the rotating component toggles a trigger member of the over-speed locking mechanism of the speed limiter assembly to trigger the speed limiter assembly.

Figure 3:
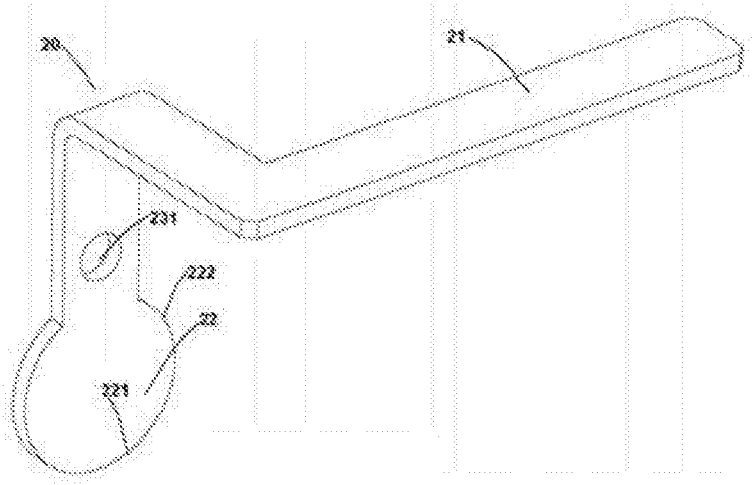
FIG. 3 illustrates an enlarged view of a rotating component of a remote trigger device of the speed limiter assembly according to a first embodiment of the present invention.

More specifically, in the first embodiment, a specific shape of the rotating component 20 is illustrated in FIG. 3. The rotating component 20 comprises a rotating center or a rotating axis. For example, the rotating component 20 may comprise a mounting hole 231. A pin 23 can be inserted into the mounting hole 231, such that the rotating component is capable of rotating along the axis A-A defined by the pin 23. The rotating component 20 further comprises a first end 21. The first end 21 is used for being engaged with the actuator 11 to receive a pushing force from the actuator 11. In some embodiments, the first end 21 is configured as a plane portion perpendicular to the rotating plane, and the actuator 11 may act on the plane portion to actuate the rotating component 20 to rotate towards the working position. The first end 21 which is formed as the plane portion can more easily receive the pushing force from the actuator 11. The rotating component 20 further comprises a second end 22. The second end 22 is used for guiding or toggling the trigger member of the over-speed locking mechanism. In some embodiments, the second end 22 of the rotating component 20 is provided with an arc-shaped guide side. Preferably, in some embodiments, the guide side comprises a first guide side 221 and a second guide side 222. As described below, the arc-shaped guide side, when in contact with the trigger member of the over-speed locking mechanism, can gradually and gently guide or toggle the trigger member. In some embodiments, the second end 22 of the rotating component 20 may be formed in the shape of a disc. Outer arcs at different circumferential positions of the disc-shaped second end define the first guide side 221 and the second guide side 222, respectively. In some embodiments, the first end 21 and the second end 22 of the rotating component 20 form an angle, for example, any angle between 60 degrees and 120 degrees or any angle between 30 degrees and 150 degrees. In one embodiment, the first end 21 and the second end 22 of the rotating component 20 are substantially perpendicular to each other. In the embodiment illustrated in FIG. 1, the second end 22 is used for toggling the tripping bar 40 of the over-speed locking mechanism, specifically, an axial extension portion 42 of the tripping bar 40 of the over-speed locking mechanism, so as to enable the tripping bar 40 to be disengaged from the ratchet tooth 30 to thereby remotely trigger the speed limiter assembly.

Figure 2:
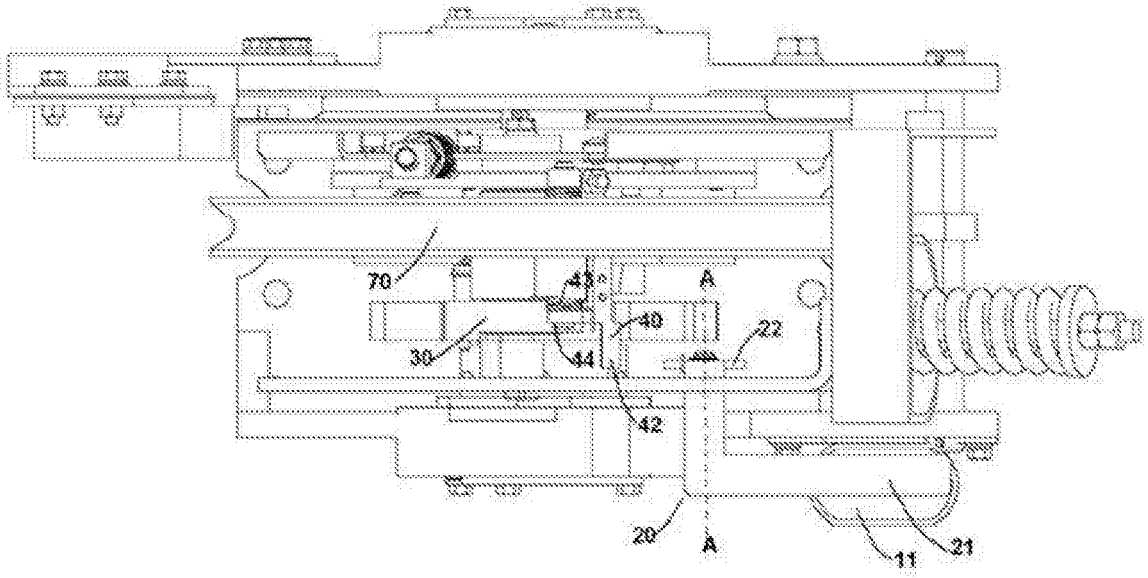
FIG. 2 illustrates a top view of the speed limiter assembly according to a first embodiment of the present invention.
Figure 4:
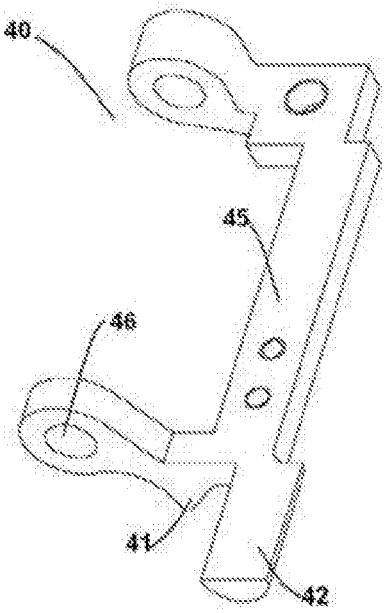
FIG. 4 illustrates an enlarged view of a tripping bar of the speed limiter assembly according to a first embodiment of the present invention.

FIG. 4 illustrates an enlarged view of the tripping bar 40. The tripping bar 40 is provided with a mounting hole 46 to thereby be rotatably mounted onto the rope sheave 70 through a pin 44. The torsion spring 43 can be mounted on the pin 44 to enable the tripping bar 40 to have a tendency to clockwise rotate. The tripping bar 40 is provided with the tooth 41 which is used for fitting with the tooth groove 321 of the ratchet tooth 30. The tripping bar 40 further comprises the axial extension portion 42. As illustrated in FIG. 2, the axial extension portion 42 is aligned with the guide side of the second end 22 of the rotating component, so as to be in contact with the second end 22 of the rotating component at the working position.

Figure 5:
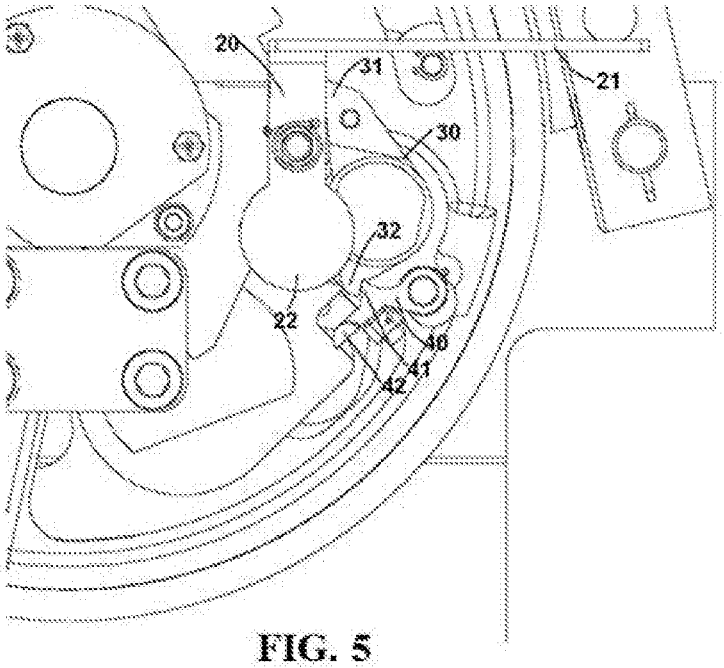
FIG. 5 illustrates a partial view of the speed limiter assembly according to a first embodiment of the present invention, with the rotating component being at an idle position.

Now, working modes of the speed limiter assembly and the remote trigger device therein are described in detail with reference to FIGS. 5-8. It should be noted that for the purposes of clarity, partial components including the actuator are removed in FIGS. 5-8. FIG. 5 illustrates a schematic view of the rotating component 20 at the idle position. At the idle position, the second end 22 of the rotating component 20 and the axial extension portion 42 of the tripping bar 40 are located at different radial positions which are differently distant from a rotating center of the rope sheave. In other words, when the tripping bar 40 goes by the rotating component 20, the second end 22 of the rotating component 20 is located on a radial inner side of the axial extension portion 42 of the tripping bar 40, i.e., the second end 22 of the rotating component 20 and the axial extension portion 42 are kept separated from each other and not in contact with each other. At this moment, when the tripping bar 40 anticlockwise rotates with the rope sheave 70 and does not move relative to the rope sheave 70, the axial extension portion 42 of the tripping bar 40 is allowed to freely pass.

Figure 6:
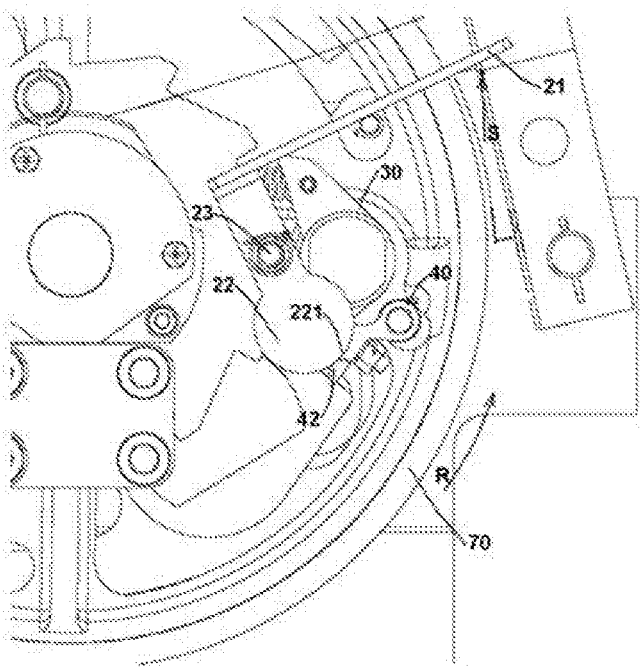
FIGS. 6-8 illustrate partial views of the speed limiter assembly according to a first embodiment of the present invention, with the rotating component being at a working position and gradually acting on the tripping bar of the speed limiter assembly.
Figure 7:
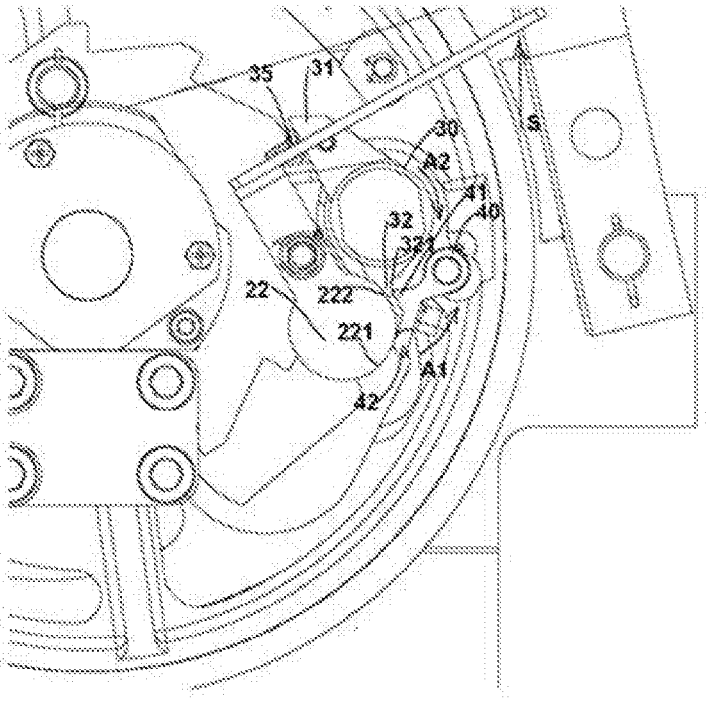
Figure 8:
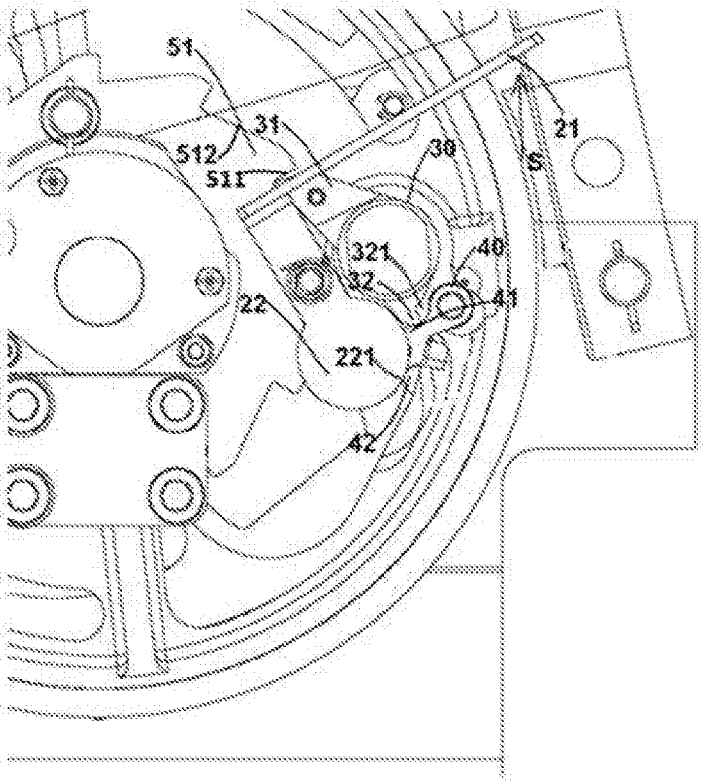

In FIGS. 6-8, for example, since a remote switch is turned on, the first end 21 of the rotating component 20 rotates by a predetermined angle to the working position under the effect of the actuator (represented by an arrow S). In a state illustrated in FIG. 6, the rope sheave 70 anticlockwise rotates in a direction R to a position at which the axial extension portion 42 of the tripping bar 40 just starts to be in contact with the arc-shaped guide side of the second end 22 of the rotating component 20, more specifically, in contact with the first guide side 221 which anticlockwise rotates corresponding to the speed limiter assembly. As illustrated in FIG. 7, with further rotation of the rope sheave in the anticlockwise direction, the first guide side 221 of the second end 22 of the rotating component 20 outwards guides the axial extension portion 42 of the tripping bar 40, gradually and gently toggles the tripping bar 40 to slightly rotate relative to the rope sheave 70 in the anticlockwise direction shown by an arrow A1, and thereby drives the ratchet tooth 30 to overcome a pulling force of the spring 35 at the first end 31 thereof to slightly clockwise rotate relative to the rope sheave 70 in a direction shown by an arrow A2, such that the tooth 41 of the tripping bar 40 is disengaged from the tooth groove 321 of the second end 32 of the ratchet tooth 30. After the tooth 41 of the tripping bar 40 is disengaged from the tooth groove 321 of the second end 32 of the ratchet tooth 30, as illustrated in FIG. 8, due to the pulling force of the spring 35, the ratchet tooth 30 will anticlockwise rotate relative to the rope sheave 70 and therefore the first end 31 thereof abuts against the tooth 51 of the ratchet wheel 50, more specifically, abuts against the first side 511 with a negative angle of the tooth 51, to thereby restrict the further rotation of the rope sheave in the anticlockwise direction.

In processes illustrated in FIGS. 6-8, due to rotational movement of the rotating component, the second end of the rotating component 20 outwards moves in a radial direction to get close to the axial extension portion 42 of the tripping bar 40. When the tripping bar 40 continuously anticlockwise rotates with the rope sheave 70, the axial extension portion 42 of the tripping bar 40 moves along the first guide side 221 of the second end 22 of the rotating component 20. The first guide side 221 of the rotating component 20 may be in an arc shape as illustrated in the figure, or in an alternative embodiment, the first guide side 221 of the rotating component 20 may also be planar or in other shapes. A rotating angle of the rotating component 20 and the shape of the first guide side 221 may be configured to enable the axial extension portion 42 of the tripping bar 40 to anticlockwise rotate relative to the rope sheave 70 in the direction A1 such that the tooth 41 of the tripping bar 40 is capable of being disengaged from the tooth groove 321 of the second end 32 of the ratchet tooth 30.

The second end 22 of the rotating component 20 further comprises a second guide side 222. The second guide side 222 acts when the rope sheave 70 clockwise rotates. When the rope sheave clockwise rotates, i.e., corresponding to ascending of the elevator car, the rotating component 20 may be enabled at the working position due to misoperation, for example. At this moment, the second guide side 222 enables the axial extension portion 42 of the tripping bar 40 to be capable of smoothly passing. Although the tooth 41 of the tripping bar 40 will be also disengaged from the tooth groove 321 of the ratchet tooth 30 when the axial extension portion 42 of the tripping bar 40 goes by the second guide side 222, the first end 31 of the ratchet tooth 30 will be guided by a second side 512 with a gentle positive angle of the tooth 51 of the ratchet wheel 50. The second side 512 of the tooth 51 of the ratchet wheel 50 will guide the ratchet tooth 30 and the tripping bar 40 to be restored to a mutually restricted state illustrated in FIG. 5 while the speed limiter assembly is not triggered.

Now, a second embodiment of a speed limiter assembly and a remote trigger device therein is described with reference to FIGS. 9-15. The speed limiter assembly illustrated in FIG. 9 and FIG. 10 is substantially the same as the speed limiter assembly illustrated in FIG. 1 and FIG. 2, except that an improved tripping bar 400, a wing member 410 and a rotating component 200 are used therein.

Figure 11:
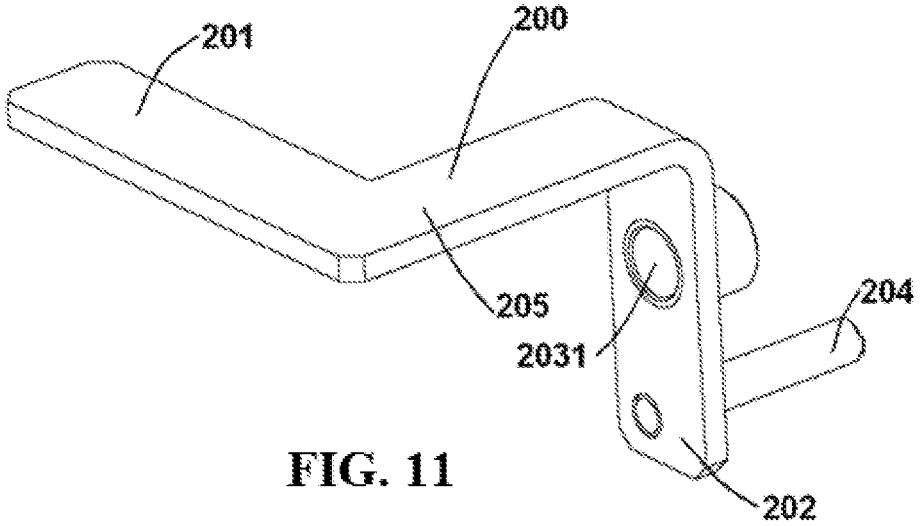
FIG. 11 illustrates an enlarged view of a rotating component of a remote trigger device of the speed limiter assembly according to a second embodiment of the present invention.
Figure 12:
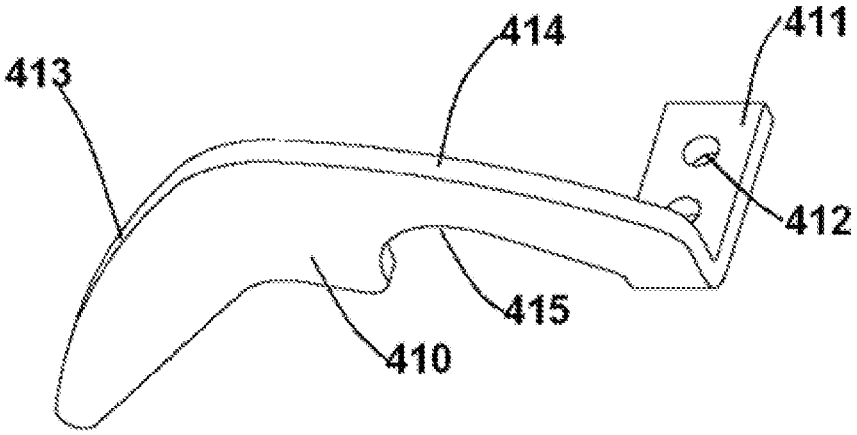
FIG. 12 illustrates an enlarged view of a locking plate of the speed limiter assembly according to a second embodiment of the present invention.

As illustrated in FIG. 11, the rotating component 200, actuated by actuator 110, comprises a rotating center or a rotating axis. For example, the rotating component 200 may be provided with a mounting hole 2031, and the rotating component 200 may be rotatably mounted onto a support through a pin 203 and a torsion spring 206. The rotating component 200 can rotate around the pin 203 and the pin 203 defines a rotating axis B-B. The torsion spring 206 acts on the rotating component 200 such that the rotating component 200 tends to be restored to an idle position. The rotating component 200 further comprises a first end 201 used for fitting with an actuator to receive a pushing force of the actuator. In some embodiments, the first end 201 is formed as a plane portion perpendicular to a rotating plane. The first end 201 is connected with a transition section 205 such that the actuator and the other portions of the rotating component 200 are staggered in an axial direction. The rotating component 200 further comprises a second end 202 used for toggling a trigger member of an over-speed locking mechanism. In this embodiment, the second end is formed to have an axial extension portion, e.g., a pillar 204 which extends in the axial direction.

Figure 9:
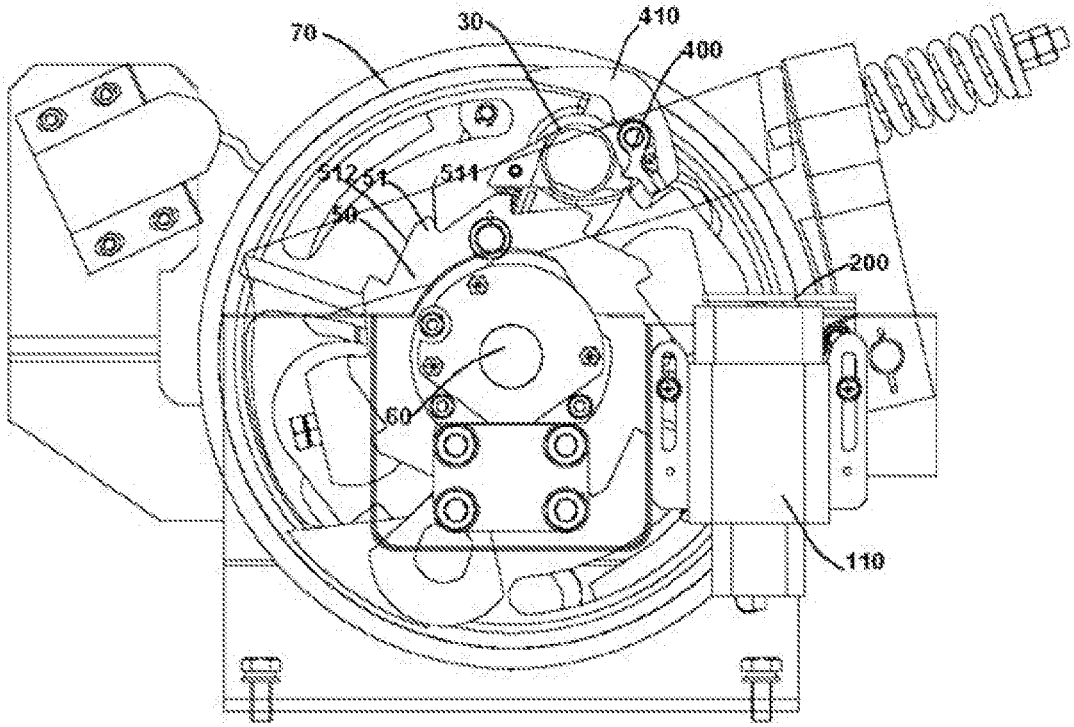
FIG. 9 illustrates a front view of a speed limiter assembly according to a second embodiment of the present invention.
Figure 10:
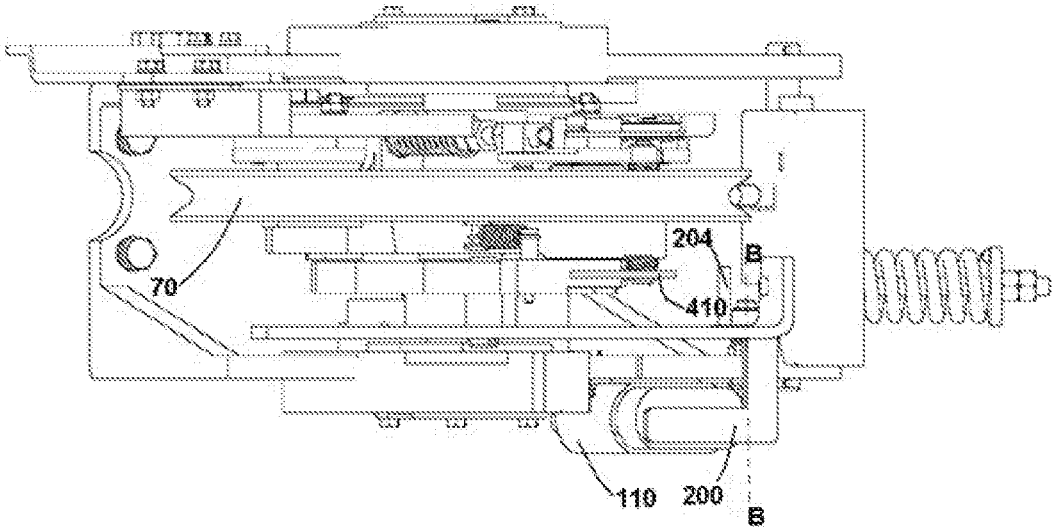
FIG. 10 illustrates a top view of a speed limiter assembly according to a second embodiment of the present invention (≈30°)

In the second embodiment illustrated in FIG. 9, in comparison with the tripping bar 40 in the first embodiment, the axial extension portion 42 is removed from the improved tripping bar 400. The improved trigger member is a wing member 410 illustrated in FIG. 12. The wing member 410 is provided with a mounting portion 411 for connection with the tripping bar 400. The mounting portion 411, for example, comprises several mounting holes 412 which allow bolts to penetrate. The wing member 410 further comprises a wing portion, and an outer side of the wing portion at least defines a first guide side 413. In some embodiments, the wing portion further defines a second guide side 414. An inner side of the wing portion defines a profile 415 which encloses the tripping bar 400. As illustrated in FIG. 10, the wing member 410 is aligned with the pillar 204, which extends in the axial direction, of the second end 202 of the rotating component 200, such that the pillar 204, at the working position, which extends in the axial direction can interact with the wing member 410.

Figure 13:
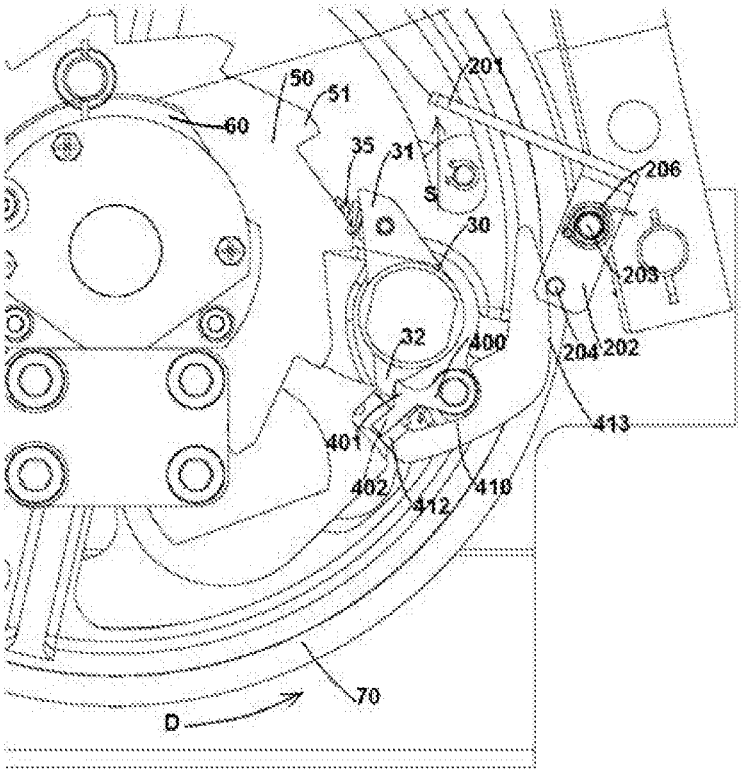
FIGS. 13-15 illustrate partial views of the speed limiter assembly according to a second embodiment of the present invention, with the rotating component being at a working position and gradually acting on a tripping bar of the speed limiter assembly.
Figure 14:
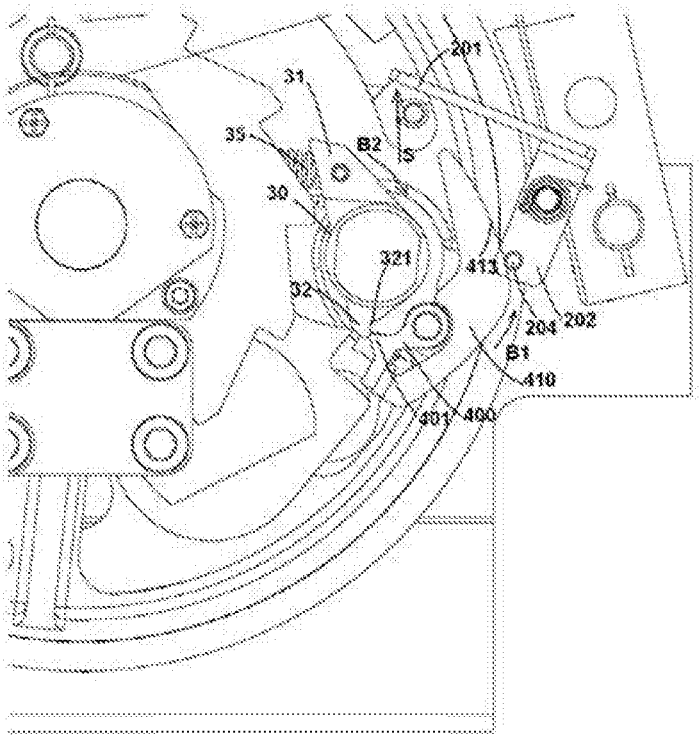
Figure 15:
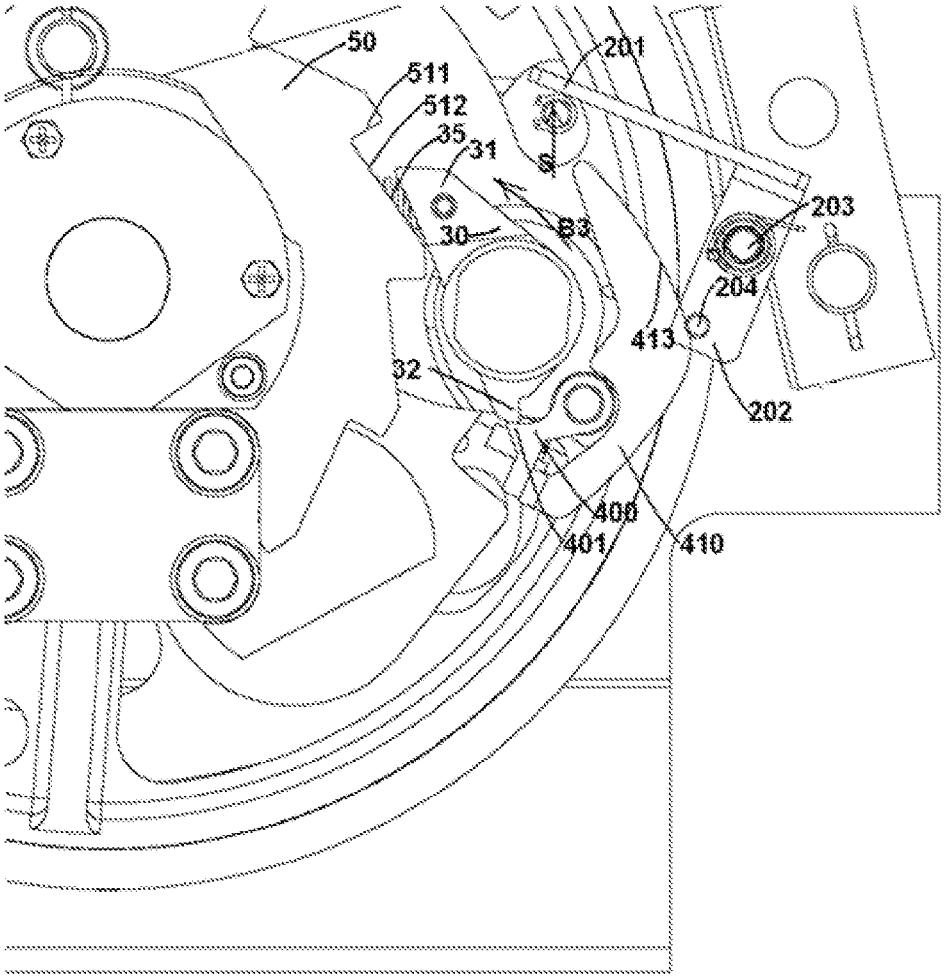

Now, a working mode of the remote trigger device according to the second embodiment is introduced in detail with reference to FIGS. 13-15. Although not illustrated, when the rotating component 200 is at the idle position, the pillar 204, which extends in the axial direction, of the second end of the rotating component and the wing member 410 of the tripping bar are located at different radial positions which are differently distant from a rotating center of the rope sheave, in a manner similar to that shown in FIG. 9. In other words, the pillar 204 which extends in the axial direction is located at a radial outer side of the wing member 410, such that the tripping bar 400 can freely pass when the tripping bar 400 rotates with the rope sheave 70 to go by a position near the rotating component 200.

At the working position illustrated in FIG. 13 to FIG. 15, the rotating component 200 is pushed by the actuator at the first end 201 to clockwise rotate by a predetermined angle along the rotating axis defined by the pin 203 in a rotating plane which is substantially in parallel with the rope sheave 70. With the rotation, the pillar 204, which extends in the axial direction, of the second end of the rotating component 200 inwards moves in a radial direction to get close to the wing member 410 of the tripping bar 400. In a state illustrated in FIG. 13, the first guide side 413 of the wing member 410 of the tripping bar 400 just starts to be in contact with the pillar 204, which extends in the axial direction, of the second end 202 of the rotating component 200. As illustrated in FIG. 14, with further rotation of the rope sheave in the anticlockwise direction, the pillar 204, which extends in the axial direction, of the second end 202 of the rotating component 200 inwards guides the wing member 410 of the tripping bar 400, gradually and gently enables the tripping bar 400 to slightly rotate relative to the rope sheave 70 in an anticlockwise direction shown by an arrow B1, and drives the ratchet tooth 30 to overcome a pulling force of the spring 35 at the first end 31 thereof to slightly clockwise rotate in a direction shown by an arrow B2, such that the tooth 401 of the tripping bar 400 is disengaged from the tooth groove 321 at the second end 32 of the ratchet tooth 30. After the tooth 401 of the tripping bar 400 is disengaged from the tooth groove 321 at the second end 32 of the ratchet tooth 30, as illustrated in FIG. 15, due to the pulling force of the spring 35, the ratchet tooth 30 anticlockwise rotates relative to the rope sheave 70 and the first end 31 thereof abuts against the tooth 51 of the ratchet wheel 50, to thereby restrict the further rotation of the rope sheave 70 in the anticlockwise direction.

The wing member 410 further defines a second guide side 414. Similar to the first embodiment, the second guide side 414 acts when the rope sheave 70 clockwise rotates. The existence of the second guide side 414 guarantees that the wing member 410 is capable of smoothly passing. Although this also causes the tripping bar 400 to be disengaged from the ratchet tooth 30, the forward second guide side 512 of the ratchet wheel guides the ratchet tooth 30 back to a non-trigger position when the rope sheave clockwise moves, while the speed limiter assembly is not triggered.

Although the embodiments of the present invention are described aiming at specific speed limiter assemblies, it should be understood that the remote trigger devices according to the embodiments of the present invention may be applied to other various types of speed limiter assemblies, wherein the rotating component rotates to radially inwards or outwards get close to the trigger member of the over-speed locking mechanism to trigger the speed limiter assembly.

The present invention further aims at protecting an elevator comprising the remote trigger device or the speed limiter assembly according to the embodiments of the present invention.

The specific embodiments described above are merely used for more clearly describing the principle of the present invention. Various components are clearly illustrated or described herein such that the principle of the present invention is easier to understand. One skilled in the art may easily make various modifications or variations to the present invention without departing from the scope of the present invention. Therefore, it should be understood that these modifications or variations are all included in the patent protection scope of the present invention.

What is claimed is:

1. A remote trigger device for a speed limiter assembly, comprising:

an actuator; and a rotating component, the rotating component being capable of rotating around a rotating axis in a rotating plane, the rotating component being actuated by the actuator to rotate from an idle position to a working position, wherein at the idle position, the rotating component is kept separated from an over-speed locking mechanism of the speed limiter assembly, and at the working position, the rotating component toggles a trigger member of the over-speed locking mechanism of the speed limiter assembly to trigger the speed limiter assembly;

wherein the rotating component is rotatably mounted through a pin and an elastic element, the elastic element tends to enable the rotating component to be restored to the idle position, and the rotating component comprises a first end engaged with the actuator and a second end used for toggling the trigger member of the over-speed locking mechanism;

wherein the first end of the rotating component is formed as a plane portion perpendicular to the rotating plane and the actuator acts on the plane portion to actuate the rotating component to rotate.

2. The remote trigger device according to claim 1, characterized in that, the first end and the second end of the rotating component form an angle or the first end of the rotating component is substantially perpendicular to the second end.

3. The remote trigger device according to claim 1, characterized in that, the second end of the rotating component approaches the trigger member of the over-speed locking mechanism as the rotating component rotates.

4. The remote trigger device according to claim 1, characterized in that, the second end of the rotating component is provided with a guide side which gradually guides the trigger member of the over-speed locking mechanism.

5. The remote trigger device according to claim 4, characterized in that, the second end of the rotating component is provided with an arc-shaped guide side.

6. The remote trigger device according to claim 4, characterized in that, the guide side comprises a first guide side corresponding to a first rotating direction of the speed limiter assembly and a second guide side corresponding to a second rotating direction of the speed limiter assembly.

7. The remote trigger device according to claim 1, characterized in that, the second end of the rotating component is provided with an axial extension portion.

8. A speed limiter assembly, comprising:

a rope sheave, a safety device;

an over-speed locking mechanism associated with the rope sheave, the over-speed locking mechanism configured to be triggered by a mechanism based on centrifugal force to trigger the speed limiter assembly and start the safety device to brake an elevator car in a guide rail friction mode; and a remote trigger device configured to actively trigger the speed limiter assembly under a situation in which the elevator car is not in an over-speed condition, the remote trigger device comprising:

an actuator; and a rotating component, the rotating component being capable of rotating around a rotating axis in a rotating plane, the rotating component being actuated by the actuator to rotate from an idle position to a working position, wherein at the idle position, the rotating component is kept separated from a trigger member of the over-speed locking mechanism of the speed limiter assembly, and at the working position, the rotating component contacts the trigger member of the over-speed locking mechanism of the speed limiter assembly to trigger the speed limiter assembly; wherein the rotating component is rotatably positioned through a pin and an elastic element, the elastic element tends to enable the rotating component to be restored to the idle position, and the rotating component comprises a first end engaged with the actuator and a second end used for toggling the trigger member of the over-speed locking mechanism.

9. The speed limiter assembly according to claim 8, characterized in that, the first end and the second end of the rotating component form an angle or the first end of the rotating component is substantially perpendicular to the second end.

10. The speed limiter assembly according to claim 8, characterized in that, the second end of the rotating component approaches the trigger member of the over-speed locking mechanism as the rotating component rotates.

11. The speed limiter assembly according to claim 8, characterized in that, the first end of the rotating component is formed as a plane portion perpendicular to the rotating plane and the actuator acts on the plane portion to actuate the rotating component to rotate.

12. The speed limiter assembly according to claim 8, characterized in that, the second end of the rotating component is provided with a guide side which gradually guides the trigger member of the over-speed locking mechanism, the trigger member of the over-speed locking mechanism is provided with an axial extension portion, and the guide side of the rotating component is configured to trigger the speed limiter assembly when the axial extension portion of the trigger member of the over-speed locking mechanism moves along the guide side of the rotating component.

13. The speed limiter assembly according to claim 12, characterized in that, the second end of the rotating component is provided with an arc-shaped guide side.

14. The speed limiter assembly according to claim 13, characterized in that, the guide side comprises a first guide side corresponding to a first rotating direction of the speed limiter assembly and a second guide side corresponding to a second rotating direction of the speed limiter assembly.

15. The speed limiter assembly according to claim 8, characterized in that, the second end of the rotating component is provided with an axial extension portion, the trigger member of the over-speed locking mechanism is a wing member which is provided with an arc-shaped guide side, and the guide side of the wing member is configured to trigger the speed limiter assembly when the guide side of the wing member of the over-speed locking mechanism moves along the axial extension portion of the rotating component.

16. The speed limiter assembly according to claim 15, characterized in that, the guide side comprises a first guide side corresponding to a first rotating direction of the speed limiter assembly and a second guide side corresponding to a second rotating direction of the speed limiter assembly.

17. An elevator, characterized in that, the elevator comprises the speed limiter assembly according to claim 8.

* * * * *